US006321053B1

(12) United States Patent
Shindo

(10) Patent No.: US 6,321,053 B1
(45) Date of Patent: Nov. 20, 2001

(54) LIQUID DEVELOPING APPARATUS HAVING REGULATORY ROLLER FOR PREVENTING DEVELOPER SPREAD

(75) Inventor: Kazunori Shindo, Kashiwazaki (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/526,699

(22) Filed: Mar. 15, 2000

(30) Foreign Application Priority Data

Mar. 15, 1999 (JP) ..... 11-069251

(51) Int. Cl.[7] ..... G03G 15/10
(52) U.S. Cl. ..... 399/237; 399/249
(58) Field of Search ..... 399/237, 239, 399/240, 249

(56) References Cited

U.S. PATENT DOCUMENTS

| | | | | |
|---|---|---|---|---|
| 3,601,092 | * | 8/1971 | Satomi | 399/240 |
| 4,127,082 | * | 11/1978 | Kawabata | 399/239 |
| 5,481,342 | * | 1/1996 | Arearo et al. | 399/249 |
| 5,713,068 | * | 1/1998 | Teschendorf et al. | 399/249 |
| 5,893,012 | * | 4/1999 | Schubert et al. | 399/249 X |
| 6,049,684 | * | 4/2000 | Nishikawa et al. | 399/249 |

FOREIGN PATENT DOCUMENTS

| | | |
|---|---|---|
| 56-81870 | 7/1981 | (JP) . |
| 56-155965 | 12/1981 | (JP) . |
| 63-75778 | 4/1988 | (JP) . |
| 2-123383 | 5/1990 | (JP) . |
| 5-289528 | 11/1993 | (JP) . |
| 6-19266 | 1/1994 | (JP) . |
| 9-15981 | 1/1997 | (JP) . |
| 10-274885 | 10/1998 | (JP) . |

OTHER PUBLICATIONS

Japanese Office Action issued Jan. 18, 2000 in a related application and English translation of relevant portions.

* cited by examiner

*Primary Examiner*—Fred L. Braun
(74) *Attorney, Agent, or Firm*—Ostrolenk, Faber, Gerb & Soffen, LLP

(57) ABSTRACT

A liquid developing apparatus including a photosensitive element forming an electrostatic latent image thereon, a developing roller for supplying a developer to the photosensitive element, a squeezing roller for squeezing the photosensitive element, and a regulatory roller for preventing the spread of the surplus developer. By employing the liquid developing apparatus, most of the developer on the photosensitive element can be maintained thereon and properly discharged.

11 Claims, 4 Drawing Sheets

LIQUID DEVELOPING APPARATUS HAVING REGULATORY ROLLER FOR PREVENTING DEVELOPER SPREAD

BACKGROUND OF THE INVENTION (a) Field of the Invention

The present invention relates to a liquid developing apparatus, more in detail to the liquid developing apparatus in which spread of a surplus developer concentrated on both ends of a photosensitive element is prevented, an efficiency of squeezing is elevated, and the surplus developer is removed.

(b) Description of the Related Art

In some of the conventional liquid developing apparatuses, a surplus developer is removed, and adhesion of toner on a photosensitive element, a developing roller and a squeezing roller is prevented in addition to acceleration of development by applying a bias voltage to a developing element and a squeezing element.

JP-A-9(1997)-15981 describes a surplus developer removing apparatus which employs a squeezing roller including a porous elastic member and a conductive surface layer made by a material having a low surface energy and high air-permeability formed thereon. In the surplus developer removing apparatus, adhesion of toner and lowering of a function of removing the surplus developer are prevented by applying, to the squeezing roller, a voltage between several hundreds to several thousands Volts having the same polarity as that of the toner.

JP-A-6(1994)-19266 describes a liquid developing apparatus which includes a first developing electrode for applying a bias voltage having the same polarity as that of all electrostatic latent image and a second developing electrode for applying a bias voltage having the reverse polarity. In the apparatus, by making the electrodes a dish-like shape, a longer and effective developing time can be secured, a development fogging is suppressed after removing the toner on the non-image portion, and the adhesion of the toner on the developing electrodes is prevented.

JP-A-56(1981)-81870 describes a roller to which a bias voltage having a polarity reverse to that of toner is applied is disposed between a developing part and a transcribing part and near a photosensitive element to remove a surplus developer in an image-forming process.

JP-A-10(1998)-274885 describes a liquid developing apparatus in which a bias voltage is applied between a developing roller and a cleaning roller not in contact with the developing roller to remove remaining toner on the developing roller.

It is also described in a publication that first and second squeezing rollers are used in a conventional liquid developing apparatus, as shown in FIG. 1. When a photosensitive element on which a developer is applied by a developing roller (not shown) moves from left to right in FIG. 1 and passes the first squeezing roller 11, the developer is squeezed from the edges of the first squeezing roller 11, and the surplus developer is likely to be left on the both edges of the sensitive element.

The second squeezing roller 12 having a pair of removing elements 13 on the both ends thereof is mounted immediately after the squeezing roller 11 to rotate in the direction reverse to the moving direction of the photosensitive element, thereby removing the surplus toner on the belt-like photosensitive element.

Another apparatus is proposed in which air nozzles are disposed on both sides of the moving photosensitive element and near the squeezing roller to remove the developer by preventing the flow-out of the surplus developer.

However, the conventional liquid developing apparatuses have the following problems.

Since the developer supplied to the photosensitive element by means of the developing roller spreads in the direction of the roller axis when a pressure is applied to the developer by the squeezing roller, the surplus developer is likely washed away and spreads towards the both ends of the photosensitive element to be concentrated thereon. When the conventional liquid developing apparatus is applied to a so-called one-pass type color printer, a surplus developer having a first color spreading to the both ends of the photosensitive element remains to be mixed with a developer having a second color, thereby lowering the reproducibility of the colors to deteriorate chroma.

In order to solve the problem, the removal of the surplus developer remaining on the both edges of the photosensitive element may be conducted by employing the secondary squeezing roller 12 as shown in FIG. 1. However, the toner adhered to the secondary squeezing roller 12 and the abrasion thereof gradually reduce the ability of removing the developer, and a stain on the image ends is generated by the developer remaining on the both edges of the photosensitive element.

In order to remove the surplus carrier by the air nozzles, an air pump having a larger capacity is required because an amount of the surplus developer is large to increase an amount of air-flow required therefor. The employment of the air pump having the larger capacity may be a cause of pollution and a noise generated by carrier components of the developer evaporated in the apparatus.

A number of proposals have been conventionally presented as described above in which the surplus carrier is removed and the adhesion of the toner is prevented by applying the bias voltage, and the squeezing efficiency of the squeezing roller is improved by removing the surplus carrier from the developing roller, the squeezing roller and the photosensitive element. However, the conventional techniques do not pay attention to the pollution of the image edges.

SUMMARY OF THE INVENTION

In view of the foregoing, an object of the present invention is to provide a liquid developing apparatus in which spread of a surplus developer concentrated on both edges of a photosensitive element is prevented.

The present invention provides a liquid developing apparatus including: a photosensitive element having an electrostatic latent image thereon; a developing roller for supplying a developer to the photosensitive element; a squeezing roller for squeezing the photosensitive element; and a regulatory roller located upstream the squeezing roller and opposing to the photosensitive element, the regulatory roller including a pair of annular projections projecting therefrom in a radial direction in vicinity of both ends of the regulatory roller for maintaining the developer on the photosensitive element between the annular projections.

In accordance with the liquid developing apparatus of the present invention, an amount of the developer spreading beyond the annular projections is extremely small, and if necessary, the surplus developer may be discharged through a gap between the developing roller and the regulatory roller. Accordingly, most of the developer uniformly exists on the photosensitive element, and even if a small amount of the developer spreads beyond the annular projections, at least part of the developer may be returned to the photosensitive element between the annular projections.

The above and other objects, features and advantages of the present invention will be more apparent from the following description.

PREFERRED EMBODIMENTS OF THE INVENTION

Now, the present invention is more specifically described with reference to accompanying drawings.

Figure 1:
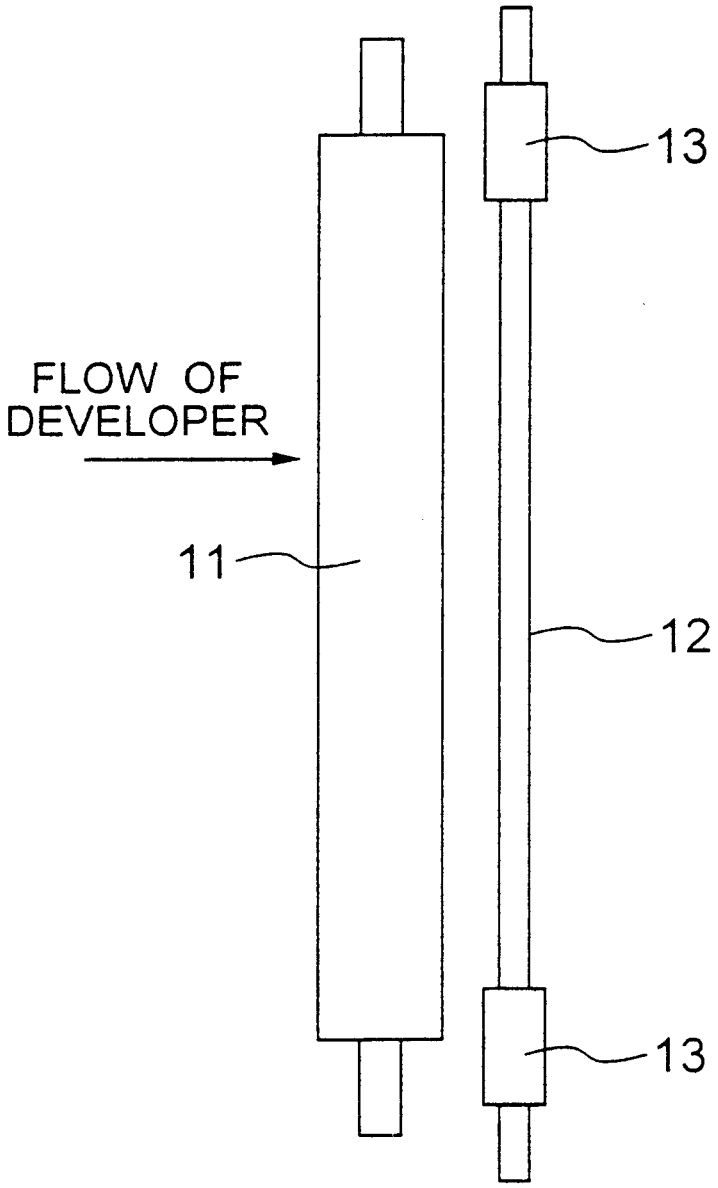
FIG. 1 PRIOR ART
FIG. 1 is a schematic top plan view showing squeezing rollers employed in a conventional liquid developing apparatus.
Figure 2:
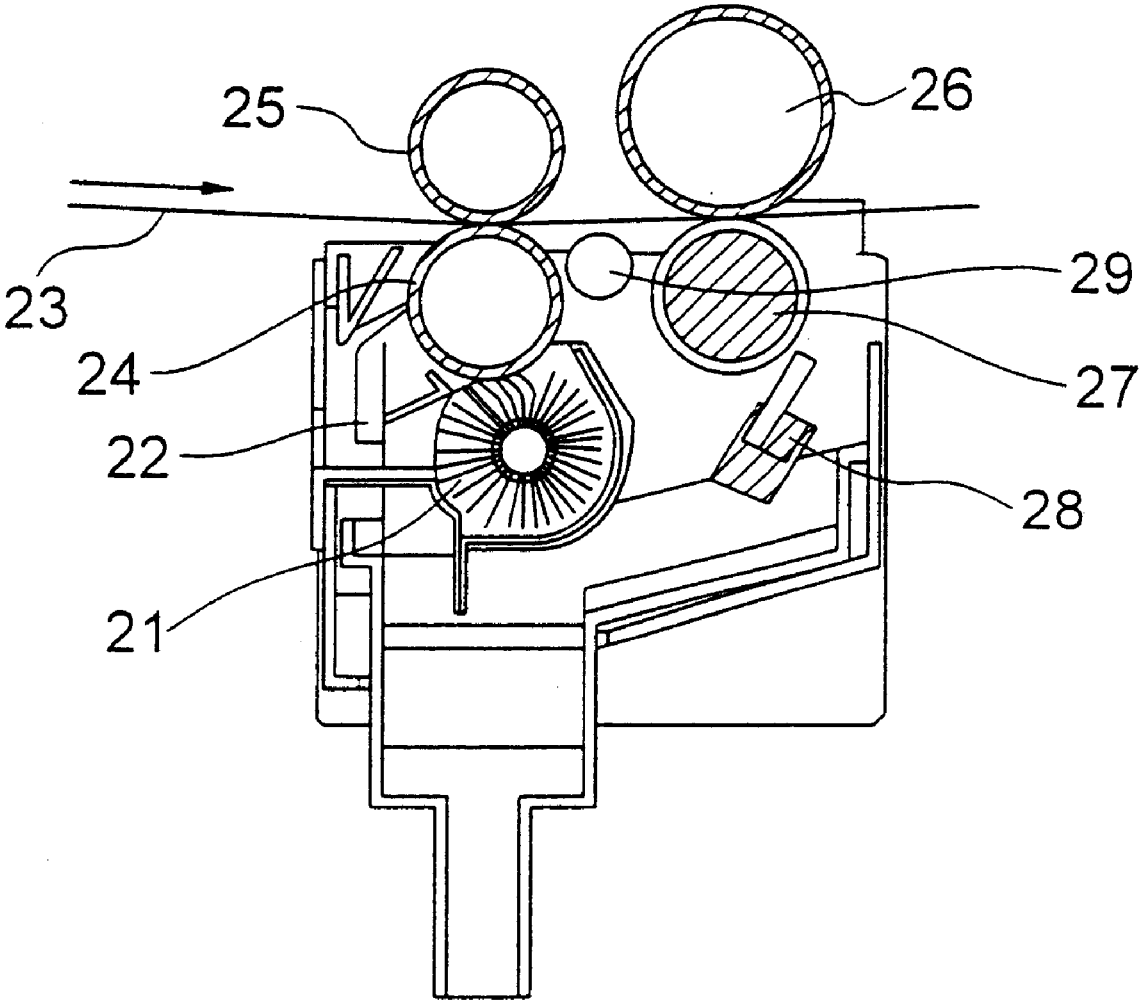
FIG. 2 is a longitudinal sectional view showing a liquid developing apparatus in accordance with an embodiment of the present invention.

Referring to FIG. 2, a liquid developing apparatus in accordance with a first embodiment of the present invention includes a belt-like photosensitive element 23 having an electrostatic latent image on the surface thereof, which moves in the direction shown by an arrow. A potential of a non-image portion is 600 V, and that of an image portion is 50 to 120 V.

A voltage of 300 to 500 V is applied to a metallic developing roller 24 made of, for example, stainless steel for generating an electric field for developing toner.

A developer supplied from a developer supply chamber 22 reaches to a developing gap between the photosensitive element 23 and a developing roller 24 having a width of 0.1 mm to 0.25 mm by the developing roller 94 rotating clockwise in FIG. 2. The electric field on the image portion extends from the developing roller 24 to the photosensitive element 23, and the toner particles positively charged deposit to the photosensitive element 23. On the other hand, the electric field on the non-image portion such as a white background extends from the photosensitive element 23 to the developing roller 24, and the toner particles deposit to the surface of the developing roller 24 in the non-image portion. The deposited toner particles are removed from the developing roller 24 by a cleaning roller 21.

A regulatory roller 29 is disposed near the developing roller 24 and the photosensitive element 23. The regulatory roller 29 has a gap of 0.25 mm or more between the photosensitive element 23 having an image portion thereon and itself wider than a developing gap not to disturb toner images on the photosensitive element 23, and rotates counterclockwise in FIG. 2. A gap of 0.1 mm or more is formed between the regulatory roller 29 and the developing roller 24 to sufficiently discharge the surplus developer therethrough. The regulatory roller 29 having such a positional relationship with the developing roller 24 and the photosensitive element 23 leads the surplus developer on the photosensitive element 23 to the gap between the developing roller 24 and the regulatory roller 29 for drain. An alternating electric field can be generated between the developing roller 24 and the regulatory roller 29 to re-disperse the toner deposited on the developing roller for preventing the adhesion of the toner.

A squeezing roller 27 is a rubber roller having a roller core and a rubber layer formed thereon. The rubber layer is formed by an elastic member such as urethane, EPDM and a nitrile rubber having a Shore hardness of 30 to 60 degrees. The squeezing roller 27 is pressed to and dependently rotates in accordance with the belt-like photosensitive element 23 supported by a backup roller 26. The pressing force is 500 to 1200 gf/cm.

Since the surface of the squeezing roller 27 is polluted with the surplus developer, a cleaning blade 28 is pressed to the squeezing roller 27 to clean the surface after the printing.

Figure 3:
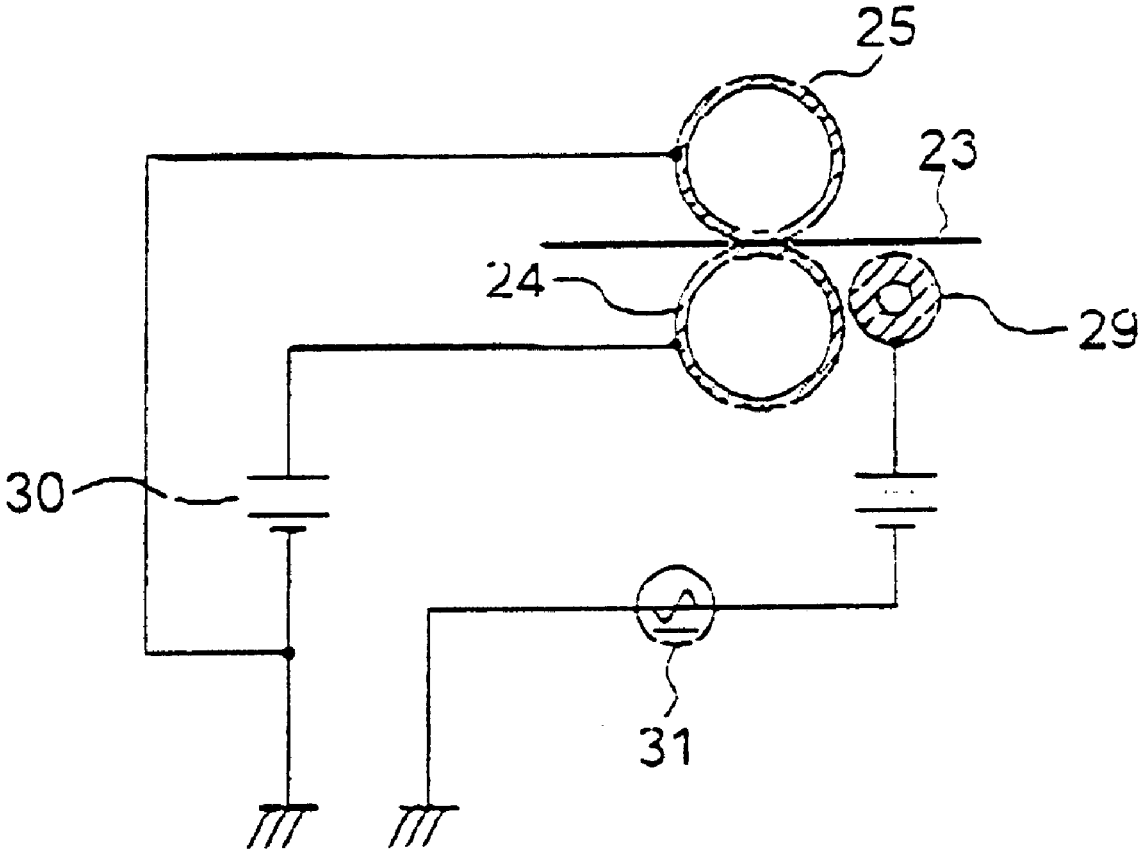
FIG. 3 is a diagram showing a high voltage circuit which may be employed in the liquid developing apparatus of FIG. 2.

Referring to FIG. 3 showing a high voltage circuit employable in the liquid developing apparatus of the present invention, a first high voltage power source 30 supplies a voltage of 300 to 500 V to the space between the development roller 24 and a first backup roller 25. A second high voltage power source 31 supplies an alternate voltage of 5 to 500 Hz to the regulatory roller 29 to generate an alternate electric field in the gap between the regulatory roller 29 and the development roller 24. The toner particles in the developer have a positive charge. The toner particles once agglomerated on the developing roller 24 by vibrations of the alternate electric field are redispersed to be smoothly removed by the cleaning roller 21.

A direct current power source for supplying a DC voltage to the regulatory roller may be employed in addition to the configuration of the high voltage circuit, for applying a voltage having a polarity reverse to that of the toner. The DC high voltage superimposed with the AC voltage is applied to the regulatory roller to generate the alternate electric field between the developing roller and the regulatory roller, thereby providing the function of preventing the adhesion of the toner to both of the developing roller and the regulatory roller.

Figure 4:
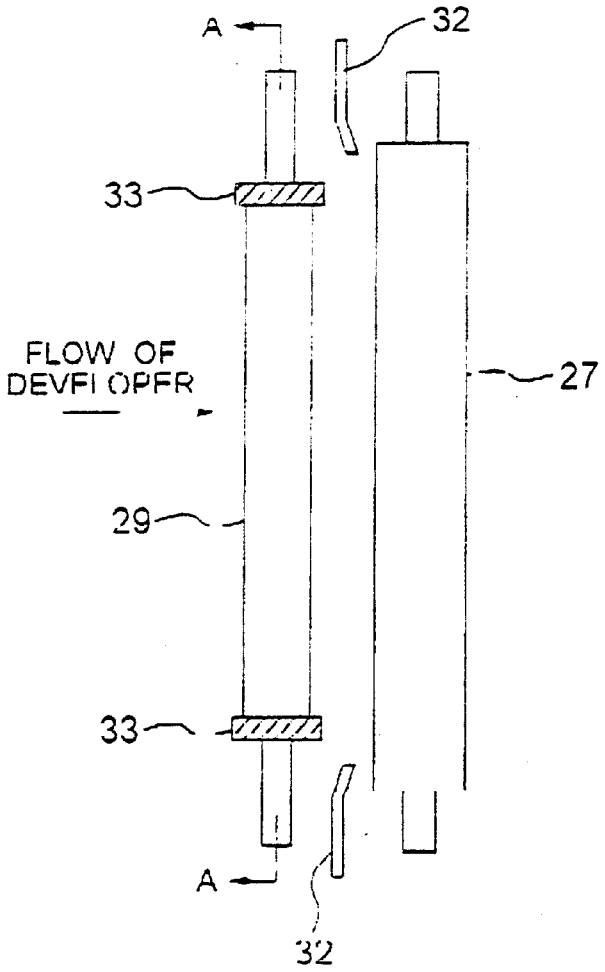
FIG. 4 is a schematic top plan view showing a configuration of a regulatory roller and air nozzles which may be employed in the liquid developing apparatus FIG. 2.

Referring to FIG. 4 showing a positional relationship between the regulatory roller 29 and air nozzles 32, the regulatory roller 29 includes a pair of annular projections 33 projecting in the radial direction from both ends. The regulatory roller 29 is disposed opposing to the developing roller through the gap and to the photosensitive element through the developer layer. Such a configuration stops the spread of the developer towards the both edges of the photosensitive element and leads the surplus developer to the gap between the development roller and the regulatory roller for removal.

Figure 5:
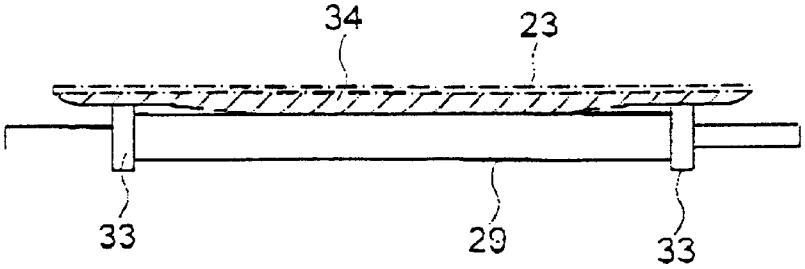
FIG. 5 is a longitudinal sectional view taken along a line A—A of FIG. 4.

The annular projections 33 of the regulatory roller 29 disposed nearer to the photosensitive element 23 than the regulatory roller 29 itself blocks the spread of the developer 34 as shown in FIG. 5. Although a small amount of the developer 34 spreads beyond the annular projections 33 because the annular projections 33 are not in direct contact with the photosensitive element 23, most of the developer remains spread out on the regulatory roller 29 between the annular projections 33 rather than being concentrated on the both edges of the annular projections 33. Even the small amount of the developer existing outside of the annular projections 33 can be returned by air-flow by the air nozzles 32 as described later. The annular projections 33 of the regulatory roller 29 are formed by considering a region to which the developer is supplied by using the developing roller and a width of the squeezing roller 27 of its axial direction, and elevates a squeezing efficiency at the both edges of the photosensitive element.

The annular projections 33 of the regulatory roller 29 may be formed by employing an elastic element such as foamed urethane and urethane rubber. Fluorine resin having a high surface energy may be coated on the surface of a metal shaft of the regulatory roller 29. The air nozzles 32 are disposed to return the developer spreading through the gap between the annular projections 33 and the photosensitive element 23 and to promote the drying.

Then, the operation of the apparatus of the present embodiment, especially of the prevention of the adhesion, will be described.

The developer including the carrier and the toner dispersed therein (developer) is supplied from the developer supply chamber 22 to the surface of the developing roller 24. The developing roller 24 rotates clockwise in FIG. 2 to form a liquid layer of the developer on its surface. The developing roller 24 and the photosensitive element 23 are opposed to each other maintaining a distance of 100 to 200 $\mu$m, and the belt-like photosensitive element 23 progresses along the first backup roller 25 and a second backup roller 26. The latent images on the surface of the photosensitive element 23 are developed by the developer on the developing roller 24.

If the toner is adhered on the developing roller 24, the image density becomes unstable. The adhered toner must be removed by the cleaning roller 21 to perform the next developing. If the alternate electric field is formed between the developing roller 24 and the regulatory roller 29 during the above removal, the toner adhered on the developing roller 24 is redispersed to be easily removed by the cleaning roller 21.

The toner density of the toner image immediately after the developing is between 20 and 50%, and a large amount of the surplus carrier liquid (developer) is deposited. The surplus developer is removed while the spread of the developer to outside of the image portion is prevented by the regulatory roller 29. The developer in the toner can be concentrated to a density of 50 to 70% by applying a pressure of 1 to 10 kgf/cm$^2$ by employing the squeezing roller 27. An agglomeration force among the toner particles changes the toner from a liquid state to a semisolid state on the photosensitive element 23.

The surplus developer compressed and extracted by the squeezing roller 27 tries to flow outside of the image portion along the squeezing roller 27. However, air flow is provided to the developer at a rate of 0.5 to 2.5 liter/minute to keep the developer in the image portion.

In accordance with the liquid developing apparatus of the embodiment, the following effects in addition to those already described can be obtained.

The surplus developer which is a bar to solidifying the toner image is removed through the gap between the developing roller 24 and the regulatory roller 29 to prevent the spread of the developer outside of the image portion. The formation of the alternate electric field between the developing roller and the regulatory roller hardly deposits the toner on the developing roller and redisperses the toner agglomerated on the developing roller to easily remove the toner by the cleaning roller. Further, the voltage having the polarity reverse to that of the toner applied to the regulatory roller and the coating of the fluorine resin on the regulatory roller prevent the toner from being deposited on the regulatory roller. The toner spreading towards the both edges of the photosensitive element can be blocked by increasing the diameter of the both ends of the regulatory roller and by employing lie air nozzles.

Although the liquid developing apparatus including the belt-like photosensitive element and one developing part has been exemplified, the present invention is not restricted thereto.

For example, a one-pass type color printer may be realized by a plurality of the liquid developing apparatuses of the present embodiment. Since the color printer effectively removes the surplus developer after the developing, color mixing generated by mixing a first developer including a first color into a second developer including a second color can be prevented to provide color images having a high chroma over its life even if a toner image having the first color is fixed and developed and then a toner image having the second color is developed.

Since the above embodiments are described only for examples, the present invention is not limited to the above embodiments and various modifications or alternations can be easily made therefrom by those skilled in the art without departing from the scope of the present invention.

What is claimed is:

1. A liquid developing apparatus comprising:

a photosensitive element having an electrostatic latent image thereon;

a developing roller for supplying a developer to the photosensitive element;

a squeezing roller for squeezing the photosensitive element; and a regulatory roller located upstream the squeezing roller and opposing to the photosensitive element, the regulatory roller including a pair of annular projections projecting therefrom in a radial direction in vicinity of both ends of the regulatory roller for maintaining the developer on the photosensitive element between the annular projections.

2. The liquid developing apparatus as defined in claim 1, wherein a surplus developer is removed through a gap between the developing roller and the regulatory roller.

3. The liquid developing apparatus as defined in claim 1 further comprising a cleaning roller for cleaning the developing roller.

4. The liquid developing apparatus as defined in claim 1, wherein the annular projections are elastic.

5. The liquid developing apparatus as defined in claim 1, wherein the regulatory roller includes a metallic roller core and fluorine resin coated thereon.

6. The liquid developing apparatus as defined in claim 1 further comprising an alternate current power source for generating an alternate electric filed between the regulatory roller and the developing roller.

7. The liquid developing apparatus as defined in claim 1 further comprising a direct current power source for applying a bias voltage to the regulatory roller.

8. The liquid developing apparatus as defined in claim 1 further comprising a pair of air nozzles disposed between the regulatory roller and the squeezing roller for flowing air to the developer on the photosensitive element.

9. A color liquid developing apparatus comprising a plurality of the liquid developing apparatuses as defined in claim 1.

10. A liquid developing apparatus as defined in claim 1, wherein said regulatory roller is located so that it does not contact said photosensitive element.

11. A liquid developing apparatus as defined in claim 1, wherein said developing roller has a length that is less than the width of said photosensitive element.

* * * * *